United States Patent [19]

McQueen, Jr. et al.

[11] 4,045,640

[45] Aug. 30, 1977

[54] STAY-HOT CONTROL FOR MICROWAVE OVEN

[75] Inventors: Raymond R. McQueen, Jr., Hacienda Heights; Christian E. Buerki, Fullerton, both of Calif.

[73] Assignee: Norris Industries Inc., Los Angeles, Calif.

[21] Appl. No.: 638,890

[22] Filed: Dec. 8, 1975

[51] Int. Cl.[2] ..... H05B 9/06

[52] U.S. Cl. ..... 219/10.55 B

[58] Field of Search ..... 219/10.55 B, 10.55 C, 219/10.55 E

[56] References Cited

U.S. PATENT DOCUMENTS

| | | | |
|---|---|---|---|
| 3,320,396 | 5/1967 | Boehm | 219/10.55 B |
| 3,339,054 | 8/1967 | Deaton | 219/10.55 B |
| 3,523,170 | 8/1970 | Boehm | 219/10.55 B |
| 3,569,656 | 3/1971 | White | 219/10.55 B |
| 3,862,390 | 1/1975 | Noda | 219/10.55 B |
| 3,875,361 | 4/1975 | Fukui et al. | 219/10.55 B |

*Primary Examiner*—Arthur T. Grimley
*Attorney, Agent, or Firm*—Edward A. Sokolski

[57] ABSTRACT

The infra-red browning element of a microwave oven is automatically energized at the end of either the microwave or browning timing cycle, to provide heat to the oven for keeping the food hot (at a lower temperature than that used for browning). This end result is achieved by ganging the timing switch which controls the supply of power to the microwave and browning circuits with a switch which controls the supply of power to the stay-hot circuit. Thus, when the microwave or browning segment of the timing switch opens at the end of the timing cycle, the stay-hot segment of the timing switch is closed to supply power to the stay-hot circuit. A thermostat switch is provided in the stay-hot circuit so that the heat output of the infra-red element is regulated to a suitable temperature for stay-hot operation. Stay-hot operation is selectively set by means of a selector control to provide automatic stay-hot operation at the end of the timing cycle.

5 Claims, 1 Drawing Figure

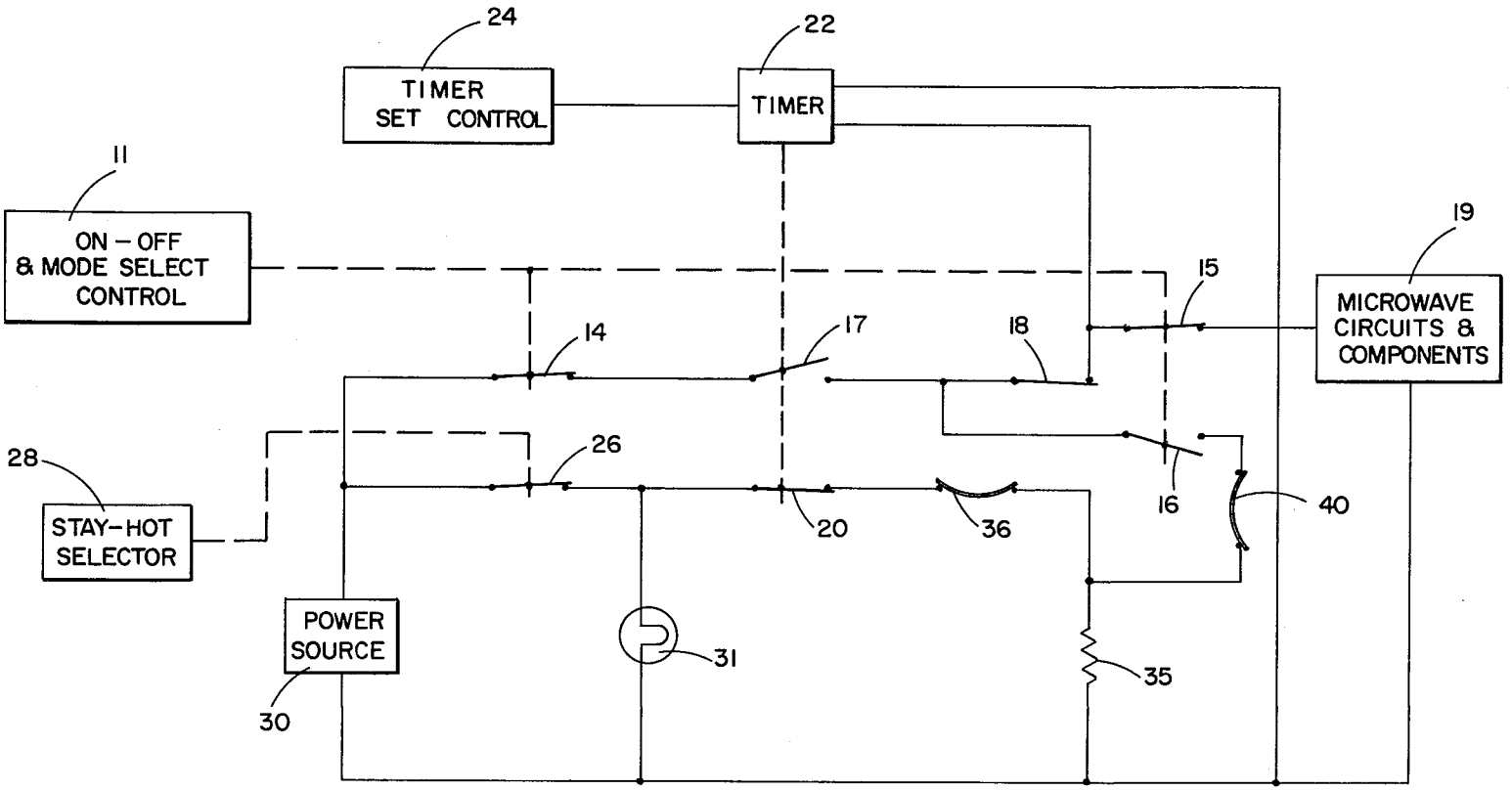
MICROWAVE CIRCUITS & COMPONENTS
19
40
15
16
35
18
36
17
20
22
TIMER
31
14
26
24
TIMER SET CONTROL
POWER SOURCE
30
11
ON - OFF & MODE SELECT CONTROL
STAY-HOT SELECTOR
28

STAY-HOT CONTROL FOR MICROWAVE OVEN

This invention relates to microwave ovens, and more particularly to a control for automatically keeping such an oven hot after its operational timing cycle has been completed.

Most microwave ovens of the prior art do not have means incorporated therein for keeping the food hot once the cooking cycle has been completed. The use of microwave energy for this purpose is generally not feasible in view of the difficulty of closely controlling this energy so that it does not continue to cook the food. Therefore, the use of an infra-red heater for this purpose is called for. In many microwave ovens, a browning element is provided in the form of an infra-red heating element. The present invention provides a control for utilizing such a browning element for additionally keeping the oven hot once the microwave cooking cycle and browning cycle (if called for) have been completed, the stay-hot operation being initiated upon the completion of either of these cycles.

It is therefore an object of this invention to provide means for automatically keeping food hot in a microwave oven when the cooking cycle has been completed.

It is a further object of this invention to provide a simple and economical control system utilizing an existing infra-red browning element for keeping food hot after cooking in a microwave oven.

Other objects of the invention will become apparent as the description proceeds in connection with the accompanying drawing.

The sole FIGURE is a schematic drawing of a preferred embodiment of the invention.

Briefly described, the device of the invention is as follows: A microwave oven includes a timer for controlling the duration of the cooking cycle. Also included in this oven is an infra-red element which may be utilized for browning the food. When it is desired that the food be kept hot after the cooking cycle has been completed, a "stay-hot" switch is actuated which provides power to a "stay-hot" control circuit. This circuit is interlocked with a switch connected to the timer, this switch being closed in response to the timer when the timing cycle for cooking has been completed and the cooking circuit deactivated. This provides power to the infra-red element through a thermostatic switch which operates to regulate the oven temperature produced by the infra-red element to that suitable for keeping the food hot without significantly continuing the cooking thereof.

Referring now to the FIGURE, a preferred embodiment of the invention is illustrated. On-Off and mode select control 11 is used to close on-off switch 14 to initiate the operation of the oven. This control is also used to alternatively either close switch 15 or switch 16. As shown in the FIGURE, switch 15 has been closed to connect the contact of switch 17 to microwave circuits and components 19, while switch 16 connects this contact to the browning circuit is opened.

Switch 17 (a normally open switch) is closed and switch 20 (a normally closed switch) is open during microwave cooking or browning operation. Switch 17 is returned to its normally open state and switch 20 is returned to its normally closed state at the end of each timing cycle in response to a cam on timer 22. These switches are returned to their microwave cooking or browning positions when the timer is reset for a new timing cycle operation by means of timer set control 24.

When stay-hot operation is desired at the end of a microwave cooking or a browning cycle, switch 26 is manually closed by means of stay-hot selector 28. This connects power source 30 through switch 26 to stay-hot indicator lamp 31, thereby indicating that the oven has been set for such operation. As already noted, during the timing cycle of timer 22 switch 17 is closed and switch 20 is open. Thus, during this time period no power is provided from power source 30 through switch 20 to infra-red heater 35. When however the timing cycle of timer 22 has been completed, switch 17 is opened and switch 20 is closed (as shown in the FIGURE), providing power through thermostatic switch 36 to heater element 35. Thermostatic switch 36 operates to regulate the temperature of the oven during stay-hot operation by controlling the supply of power to infra-red heating element 35. This thermostatic switch is calibrated to provide whatever temperature is deemed desirable to keep the food hot without significantly continuing the cooking thereof. Stay-hot operation continues until stay-hot selector 28 is manually operated to open switch 26. Switch 18 is an interlock switch which opens whenever the door of the oven is open, thereby preventing operation of the microwave circuits under such conditions.

It is to be noted in the illustrative embodiment that on-off and mode select control 11 can be utilized to alternatively initiate either the microwave circuits and components 19 or the browning function of infra-red heater 35. Thus, when the microwave cooking cycle has been completed, control 11 can be operated to close switch 16 and open switch 15, timer 22 being reset to close switch 17 to initiate a browning cycle. Under such circumstances, power will be fed through switch 16 and thermostatic switch 40 to infra-red heater 35. Thermostatic switch 40 is set to control the power to element 35 to provide an oven temperature suitable for browning which is substantially higher than that to which thermostatic switch 36 is set for the stay-hot operation. When the browning timing cycle has been completed, timer 22 will then operate to open switch 17 and close switch 20 to provide stay-hot operation.

Let us now go through a typical cooking cycle, in this example one solely utilizing microwave cooking. As shown in the FIGURE, stay-hot selector 28 is operated to close stay-hot switch 26, while control 11 is operated to close on-off switch 14 and microwave switch 15. Timer 22 is set to provide the desired timing for cooking by means of timer set control 24. With the setting of timer 22, switch 17 is closed and switch 20 is opened. Power is thus provided through switches 14, 17 and 15 to microwave circuits and components 19. Power is also provided to timer 22 to initiate the timing cycle. It is to be noted that timer 22 may comprise a timer motor (not shown). When the timing cycle has been completed, a cam on the shaft of the timer motor of timer 22 opens switch 17 and closes switch 20, thus interrupting the power to the microwave circuits and components and providing power for stay-hot operation to infra-red heating element 35. As already noted, the stay-hot operation continues indefinitely until stay-hot selector 28 is operated to open switch 26.

While the invention has been described and illustrated in detail, it is to be clearly understood that this is intended by way of illustration and example only and is not to be taken by way of limitation, the spirit and scope of this invention being limited only by the terms of the following claims.

We claim:

1. In a microwave oven including microwave cooking circuit means, a power source, a timer and switch means for connecting the power source to the cooking circuit means for a predetermined time period in response to said timer, and an infra-red heating element, the improvement whereby means are provided for automatically keeping the oven hot when said predetermined time period has elapsed comprising:

a first ("stay-hot") switch interposed between said power source and said heating element, a stay-hot selector for operating said first switch to provide stay-hot operation, a second switch interposed between said power source and said heating element and in series with said first switch, said second switch being closed and said switch means for connecting the power source to the cooking circuit means being opened in response to said timer, when said predetermined time period has elapsed, and thermostatic switch means interposed in series between said heating element and said power source for regulating the temperature of said heating element to a predetermined stay-hot temperature.

2. The oven of claim 1 and further including indicator means connected between said first switch and said power source for indicating when said first switch has been actuated to provide stay-hot operation.

3. The oven of claim 1 wherein the switch means for connecting the power source to the cooking circuit means comprises a third switch ganged with said second switch such that when the third switch is opened the second switch is closed and vice versa.

4. The oven of claim 1 and further including a browning circuit for operating the heating element for browning operation comprising switch means for alternatively feeding power from said power source to said microwave cooking circuit means or said infra-red element, and thermostatic switch means interposed between said last mentioned switch means and said infra-red element to regulate the heating thereof.

5. In a microwave oven, said oven including a microwave cooking unit and an infra-red browning unit and switch means for alternatively providing power from a power source to either one or the other of said units, the improvement being a stay-hot control for said oven comprising:

a first ("stay-hot") switch, a second switch, a "stay-hot" indicator, selector means for closing said first switch for stay-hot operation whereby said indicator is activated and the power source is connected to said second switch, a third switch, a timer, means for setting the operation of said timer to a predetermined timing cycle, said second and third switches being connected to said timer for actuation thereby, said second switch being closed and said third switch being opened when said predetermined timing cycle has been completed, a first thermostatic switch connected to said infra-red unit for regulating stay-hot operation thereof at a first predetermined temperature, said second switch operating to feed power from said power source to said first thermostatic switch when said timing cycle has been completed, said third switch operating during said timing cycle to feed power from said power source to said switch means for alternatively providing power to either of said units, and a second thermostatic switch connected to said infra-red unit for regulating browning operation thereof at a second predetermined temperature higher than said first predetermined temperature, said switch means operating to feed power from said power source to said second thermostatic switch.

* * * * *